US008873997B2

(12) United States Patent
Liu et al.

(10) Patent No.: US 8,873,997 B2
(45) Date of Patent: Oct. 28, 2014

(54) METHOD FOR BIAS MEMBER CHARGING A PHOTORECEPTOR

(71) Applicant: Xerox Corporation, Norwalk, CT (US)

(72) Inventors: Yu Liu, Mississauga (CA); Johann Junginger, Toronto (CA); Gaetano J Lavigne, Burlington (CA); Gregory Mcguire, Oakville (CA); Vladislav Skorokhod, Mississiauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 179 days.

(21) Appl. No.: 13/684,617

(22) Filed: Nov. 26, 2012

(65) Prior Publication Data

US 2014/0147163 A1 May 29, 2014

(51) Int. Cl.
*G03G 15/02* (2006.01)
*G03G 13/02* (2006.01)

(52) U.S. Cl.
CPC ..... *G03G 15/0233* (2013.01); *G03G 13/025* (2013.01); *G03G 15/0225* (2013.01); *G03G 15/0258* (2013.01); *G03G 15/0216* (2013.01)
USPC ..... 399/100

(58) Field of Classification Search
CPC ..... G03G 15/0225; G03G 15/0258
USPC ..... 399/98, 99, 100
See application file for complete search history.

(56) References Cited

U.S. PATENT DOCUMENTS

| | | | | |
|---|---|---|---|---|
| 4,111,545 | A * | 9/1978 | Meltzer | 399/351 |
| 5,585,896 | A * | 12/1996 | Yamazaki et al. | 399/174 |
| 5,873,019 | A * | 2/1999 | Mizuishi | 399/313 |
| 6,022,660 | A | 2/2000 | Uno | |
| 6,470,161 | B2 | 10/2002 | Fujishiro et al. | |
| 6,836,638 | B2 | 12/2004 | Muto et al. | |
| 7,079,786 | B2 | 7/2006 | Tanaka | |
| 7,177,572 | B2 | 2/2007 | DiRubio et al. | |
| 7,266,338 | B2 | 9/2007 | Baek | |
| 7,526,243 | B2 | 4/2009 | Zaman et al. | |
| 7,711,285 | B2 | 5/2010 | Makiura et al. | |
| 8,126,344 | B2 | 2/2012 | Handa et al. | |
| 2003/0039494 | A1 * | 2/2003 | Shakuto et al. | 399/357 |
| 2004/0013439 | A1 * | 1/2004 | Takami | 399/50 |
| 2008/0187360 | A1 * | 8/2008 | Fujita et al. | 399/176 |

* cited by examiner

*Primary Examiner* — Walter L Lindsay, Jr.
*Assistant Examiner* — Rodney Bonnette

(57) ABSTRACT

A bias charge member is pulsed into contact with a photoreceptor at high frequency as a mean to reduce contamination and wearing on both the bias charge member and photoreceptor.

17 Claims, 7 Drawing Sheets

METHOD FOR BIAS MEMBER CHARGING A PHOTORECEPTOR

BACKGROUND

1. Field of the Disclosure

This disclosure relates generally to a bias charge member, and more particularly, concerns vibrating a bias charge member in a printing apparatus.

2. Description of Related Art

In a typical electrophotographic printing process, a photoconductive member is charged to a substantially uniform potential so as to sensitize the surface thereof. The charged portion of the photoconductive member is exposed to a light image of an original document being reproduced.

Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet.

The toner particles are heated to permanently affix the powder image to the copy sheet.

In printing machines such as described above, a bias charge roller (BCR) is increasingly used as the major charging apparatus in xerographic systems due to environment friendliness and excellent charging performance. Most BCRs are contacting the photoconductive member or photoreceptor, but some manufacturers use a non-contact type BCR. A contact BCR provides several advantages over traditional scorotron charging: a) uniform and stable charging; b) reduced emissions of ozone or other corona by-products; c) lower AC/DC voltage supply requirements; and d) reduced service maintenance. The contact BCR will suffer from toner/additive contamination over many printing cycles and it is widely accepted that direct-contact BCRs increase the wear rate of the photoconductive member, reducing overall service life of both BCR and the photoconductive member. The non-contact BCR addresses these issues but demands other engineering tradeoffs, such as increased knee voltage, i.e., $V_{AC}$ to stabilize charging with an increased wear rate associated.

U.S. Pat. Nos. 8,126,344; 7,711,285; 7,526,243; 7,266,338; 7,079,786; 6,836,638; 6,470,161 are all directed to using vibration-assisted cleaning systems that vibrate at a high frequency to alleviate the adherence of particles trapped on the cleaning surface of a photoreceptor, as well as, reduce damage on the photoreceptor surface due to relaxation time provided by the vibration. Examples of bias charge rollers or brushes are shown in U.S. Pat. Nos. 7,177,572 and 6,022,660.

However, there is a continuing need for a more robustly configured BCR.

BRIEF SUMMARY OF THE DISCLOSURE

Accordingly, in answer to this need and provided hereinafter is a vibration-assisted bias charging unit in pulsed contact with a photoreceptor at high frequency as a mean to reduce contamination and wearing on both the bias charging unit and photoreceptor.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
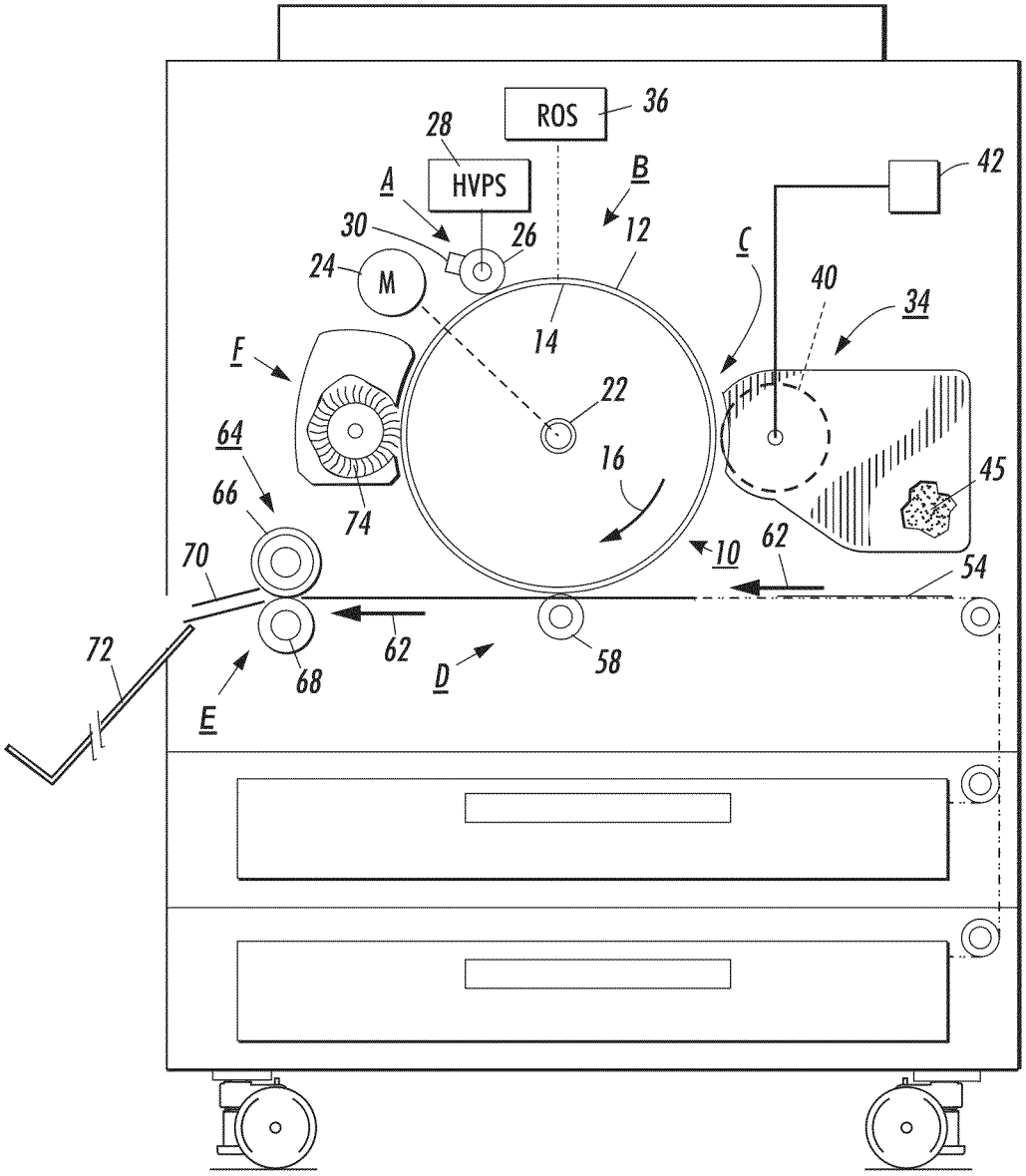
FIG. 1 schematically illustrates a xerographic device that includes a bias charging member.

While the present disclosure will hereinafter be described in connection with a preferred embodiment, it will be understood that it is not intended to limit the disclosure to that embodiment. On the contrary, it is intended to cover all alternatives, modifications and equivalents as may be included within the spirit and scope of the invention as defined by the appended claims.

For a general understanding of the features of the present disclosure, reference is made to the drawings. In the drawings, like reference numerals have been used throughout to designate identical elements.

Referring to the FIG. 1 printer 10, as in other xerographic machines, and as is well known, an electronic document or an electronic or optical image of an original document or set of documents to be reproduced may be projected or scanned onto a charged surface 12 of a photoreceptor drum 10 to form an electrostatic latent image, although photoreceptors in the form of a belt are also known, and may be substituted therefor. The drum includes a photoconductive substrate deposited on a conductive substrate and moves in the direction of arrow 16 to advance successive portions thereof sequentially through the various processing stations disposed about the path of movement thereof. Motor 24 rotates roll 22 to advance the drum in the direction of arrow 16. Drum 10 is coupled to motor 24 by suitable means such as a drive.

Initially, successive portions of the drum pass through charging station A. At charging station A, a corona generating device, in the form of a bias charging roller which is indicated generally by the reference numeral 26 connected to a high voltage power supply 28, charges the drum 10 to a selectively high uniform electrical potential, preferably negative.

In a digital printing machine as shown in FIG. 1, the drum 10 passes through imaging station B where a ROS (Raster Output Scanner) 36 may lay out the image in a series of horizontal scan line with each line having a specific number of pixel per inch. The ROS 36 may include a laser (not shown) having a rotating polygon mirror block associated therewith. The ROS 36 exposes the photoconductive surface 12 of the drum 10.

It should be appreciated that the printing machine may alternatively be a light lens copier. In a light lens copier, a document to be reproduced is placed on a platen, located at the imaging station where it is illuminated in known manner by a light source, such as, a tungsten halogen lamp. The document thus exposed is imaged onto the drum by a system of mirrors. The optical image selectively discharges the surface of the drum in an image configuration whereby an electrostatic latent image of the original document is recorded on the drum at the imaging station.

At development station C, a development system or unit, indicated by the reference numeral 34, advances developed materials into contact with the electrostatic latent images. Preferably, the developer unit includes a developer roller mounted in a housing. Thus, developer unit 34 contains a developer roller 40. The roller 40 advances toner particles 45 into contact with the latent image. Appropriate developer biasing may be accomplished via power supply 42, electrically connected to developer unit 34.

The developer unit 34 develops the charged image areas of the photoconductive surface 12 of drum 10. This development unit contains magnetic black toner particles 45, for example, which are charged by an electrostatic field existing between the photoconductive surface and the electrically biased developer roll in the developer unit. Power supply 42 electrically bases the magnetic roll 40.

A sheet of support material (image receiving member) 54 is moved into contact with the toner image at transfer station D. The sheet of support material is advanced to transfer station D by a suitable sheet feeding apparatus, not shown. Preferably, the sheet feeding apparatus includes a feed roll contacting the upper sheet of a stack of copy sheets. Feed roll rotate so as to advance the uppermost sheet from the stack into a chute which directs the advancing sheet of support material into contact with the photoconductive surface of drum 10 in a time sequence so that the toner powder image developed thereon contacts the advancing sheet of support material at transfer station D.

Transfer station D includes a corona generating device 58 in the form of a bias transfer roll, which applies ions of a suitable polarity onto the backside of sheet 54. This attracts the toner powder image from the drum 12 to sheet 54, i.e., it establishes a directional force field capable of attracting toner particles from the photoconductive surface 12 to support material 54. After transfer, the sheet continues to move, in the direction of arrow 62, onto a conveyor (not shown) which advances the sheet to fusing station E.

Fusing station E includes a fuse assembly, indicated generally by the reference numeral 64, which permanently affixes the transferred powder image to sheet 54. Preferably, fuser assembly 64 comprises a heated fuser roll 66 and a pressure roller 68. Sheet 54 passes between fuser roller 66 and pressure roller 68 with the toner powder image contacting fuser roller 66. In this manner, the toner powder image is permanently affixed to sheet 54. After fusing, a chute 70 guides the advancing sheet 54 to a catch tray 72 for subsequent removal from the printing machine by the operator. It will also be understood that other post-fusing operations can be included, for example, stapling, binding, inverting and returning the sheet for duplexing and the like.

After the sheet of support material is separated from the photoconductive surface 12, the residual toner particles carried by image and non-image areas on the photoconductive surface are removed at cleaning station F. The vacuum assisted, electrostatic, brush cleaner unit 74 is disposed at the cleaning station F to remove any residual toner remaining on the surface of the drum.

It is believed that the foregoing description is sufficient for purposes of the present application to illustrate the general operation of an electrophotographic printing machine incorporating the vibrating-assisted bias charge roll of the present disclosure therein.

Figure 2:
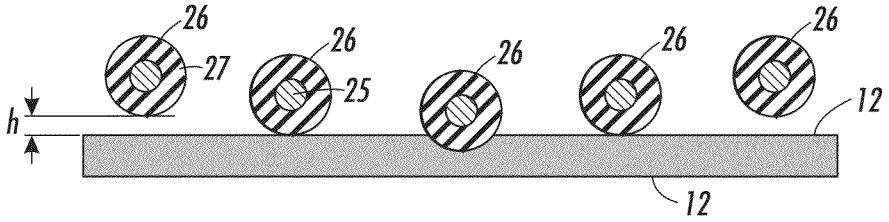
FIG. 2 is a schematic elevational view depicting vibration assisted bias charging unit with pulsed contact with the photoreceptor of the xerographic device of FIG. 1.

In accordance with the present disclosure and with beginning reference to FIG. 2, an improved bias charging unit and method for charging a photoconductive or photoreceptive surface with reduced impact on the photoreceptor (such as wear rate), reduced contamination on the charging unit, and uniform charging potential on the photoreceptor is shown. In FIG. 2, vibration-assisted bias charging roller 26 is specially equipped with a pulsed function which forms an intermittent contact of the charging roller 26 with the photoconductive surface 12. Bias charge roller 26 includes an electrically conductive core 25 and an outer layer 27 axially supported on the core. Initially, as shown at the left side of FIG. 2, bias charge roller 26 is out of contact with photoconductive surface 12 at a predetermined height "h" and is then pulsed serially into contact and out of contact with photoconductive surface 12. One actuator mechanism for pulsing the bias charge roller 26 is a conventionally mounted piezoelectric transducer (PZT) 30. Other actuators can also be used including, for example, an electric motor, a pneumatic actuator, a hydraulic actuator, a linear actuator, a combination drive, thermal bimorphs and electroactive polymers. The pulsing of the bias charging roller had a duty cycle from about 5% to about 95%. Since charging unit 26 is in a vibration mode, there is little chance for toner or additives to become trapped on its surface. Thus, both of contamination and wear rate of the bias charge roller and photoreceptor is reduced.

While a bias charge roller 26 is shown as an example in FIG. 1, it should be understood that other bias charge members could be used as well including, for example, a brush, a pad, a blade, etc.

To examine charging performance of a vibration-assisted BCR, a half-cylindrical BCR pad was fabricated with an integrated actuator in the form of PZT to tap the BCR pad against photoreceptor drum with the BCR pad having a surface resistivity of from about 103 ohm/m to about 1013 ohm/m. A high voltage power supply (HVPS) was in connection with a metal core of the BCR pad. The BCR pad was driven by the PZT with tunable frequency and amplitude. Between the PZT and metal core of the BCR pad, an insulating layer was placed to protect the PZT under high voltage shocking. Scoping tests were done on an 84 mm UDS scanner with drum rotation speed at 3 rps.

Figure 3A:
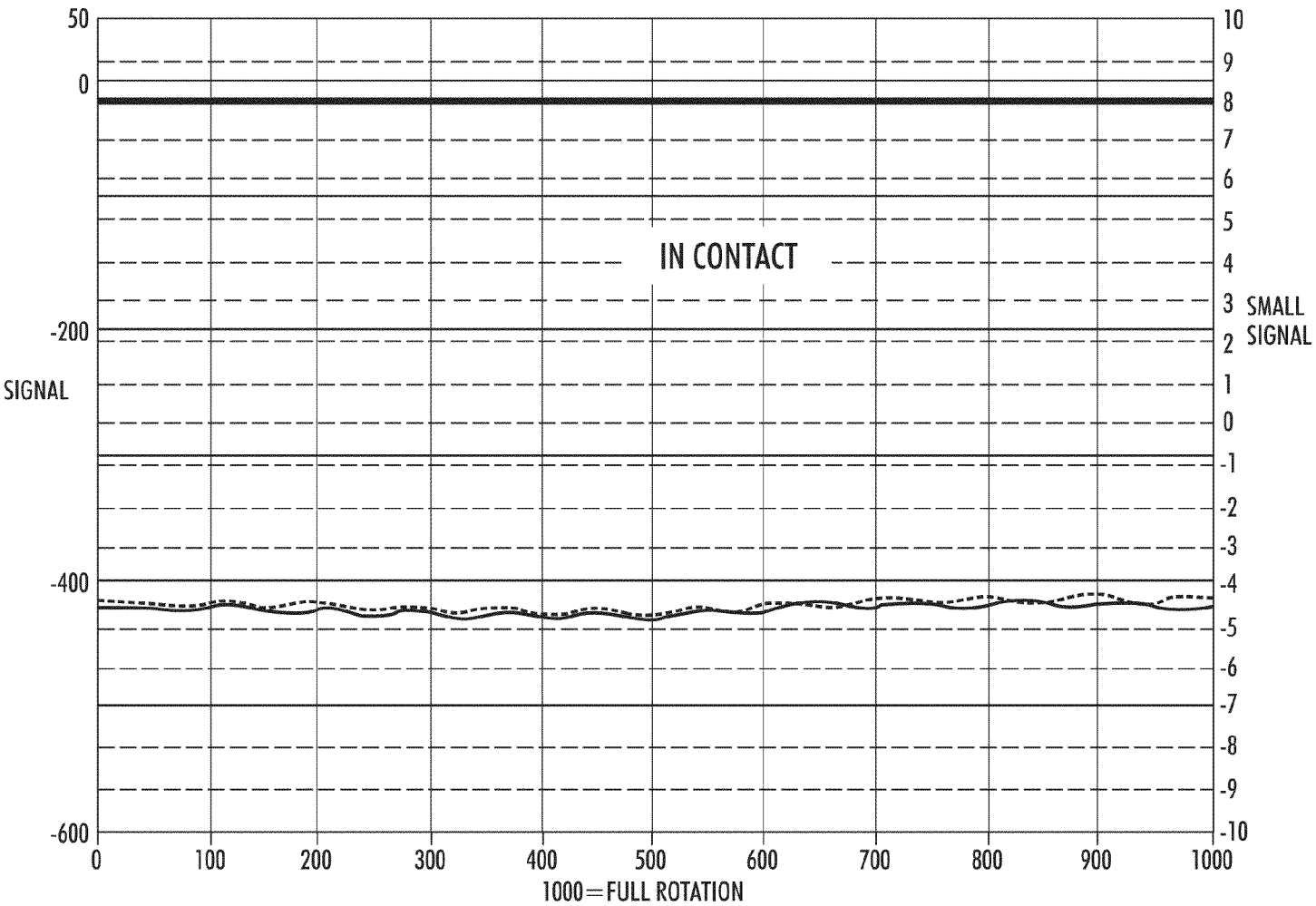
FIG. 3A is a chart showing a charging curve resulting from a bias charging roll charging roll in static contact with a rotating photoreceptor.
Figure 3B:
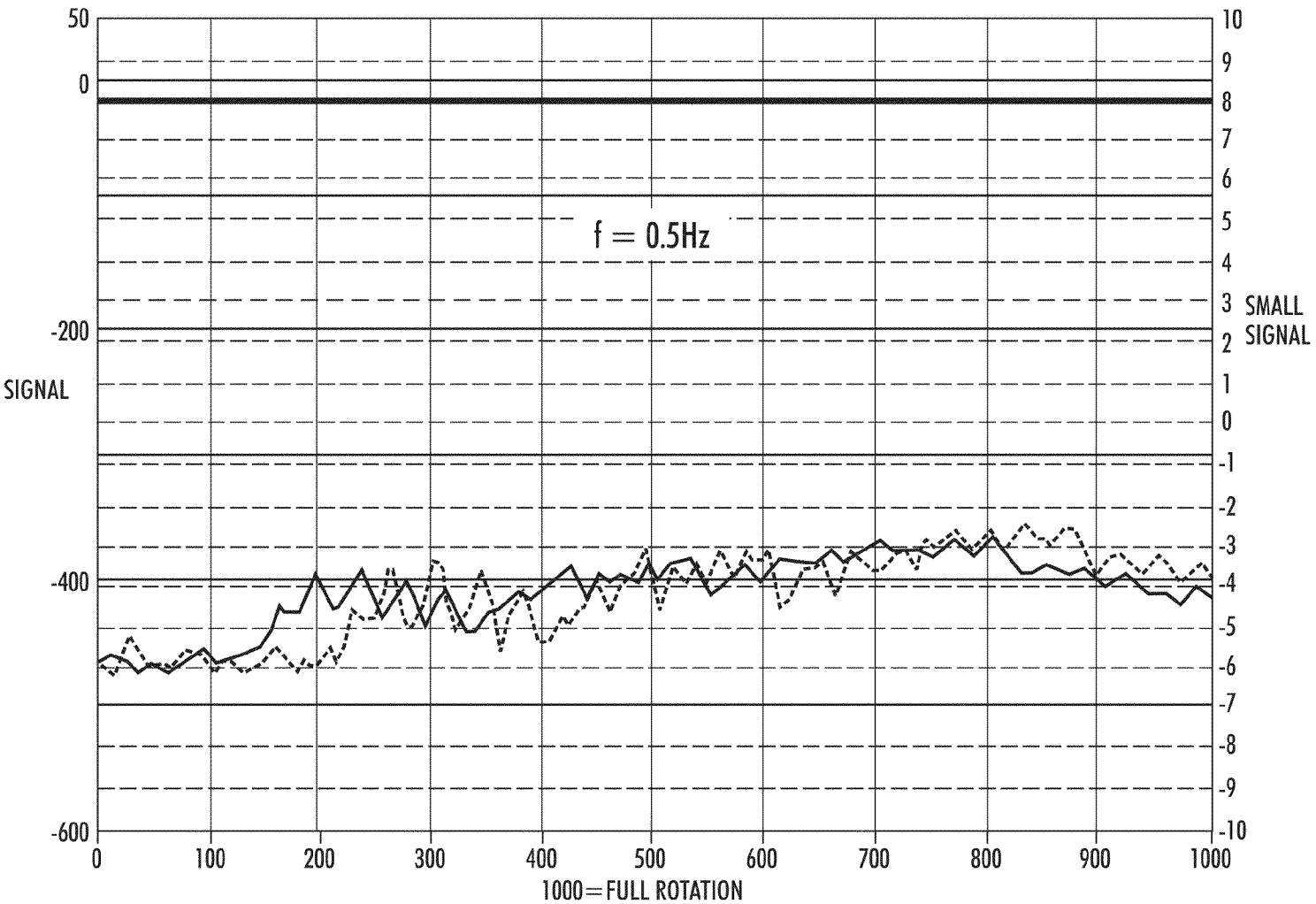
FIG. 3B is a chart showing visibly distorted charging curves resulting from a bias charging roll pulsed at a driving frequency of 0.5 Hz as related with non-uniform charging.
Figure 3C:
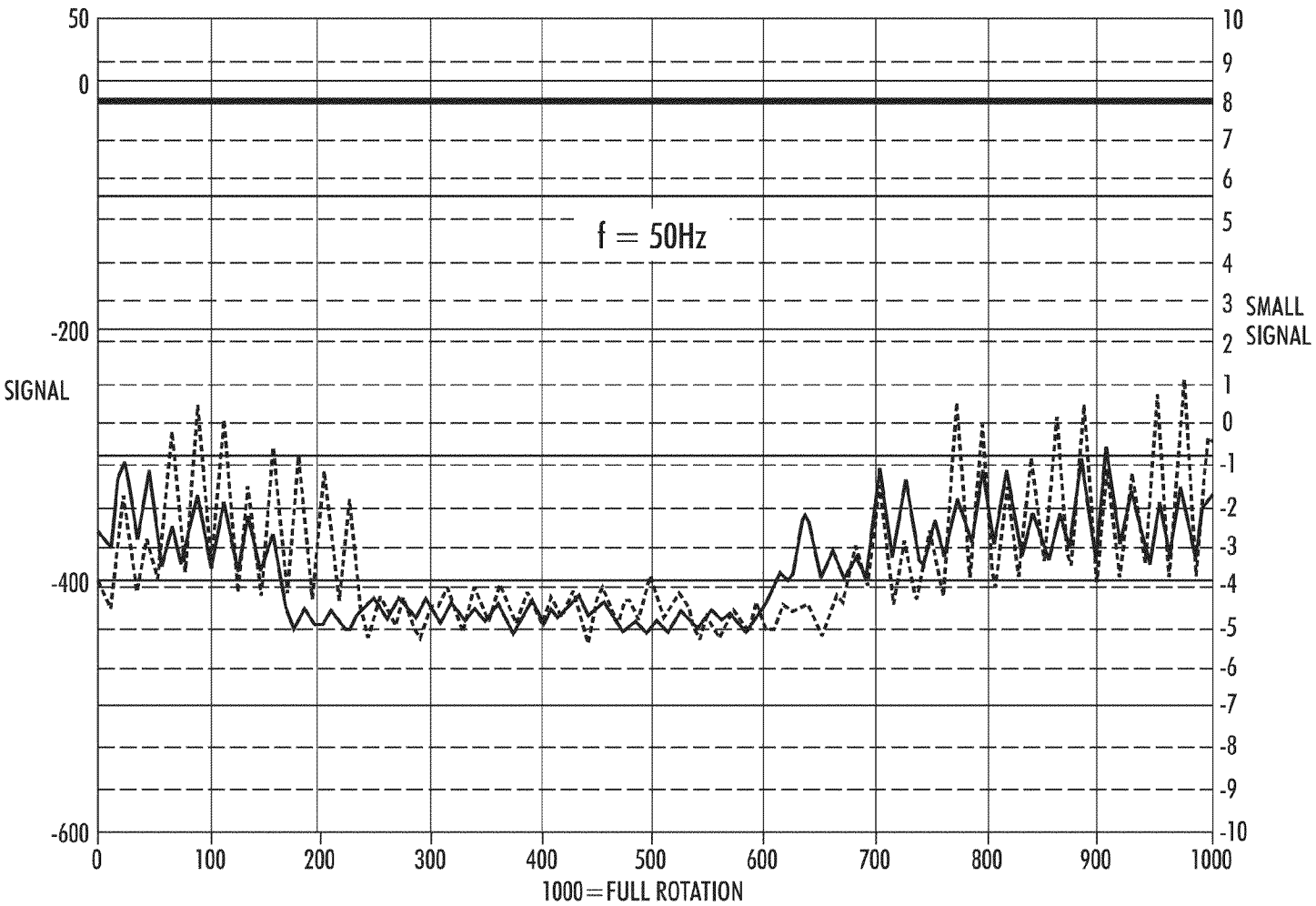
FIG. 3C is a chart showing a visibly distorted charging curves resulting from a bias charging roll pulsed at a driving frequency of 50 Hz as related with non-uniform charging.
Figure 3D:
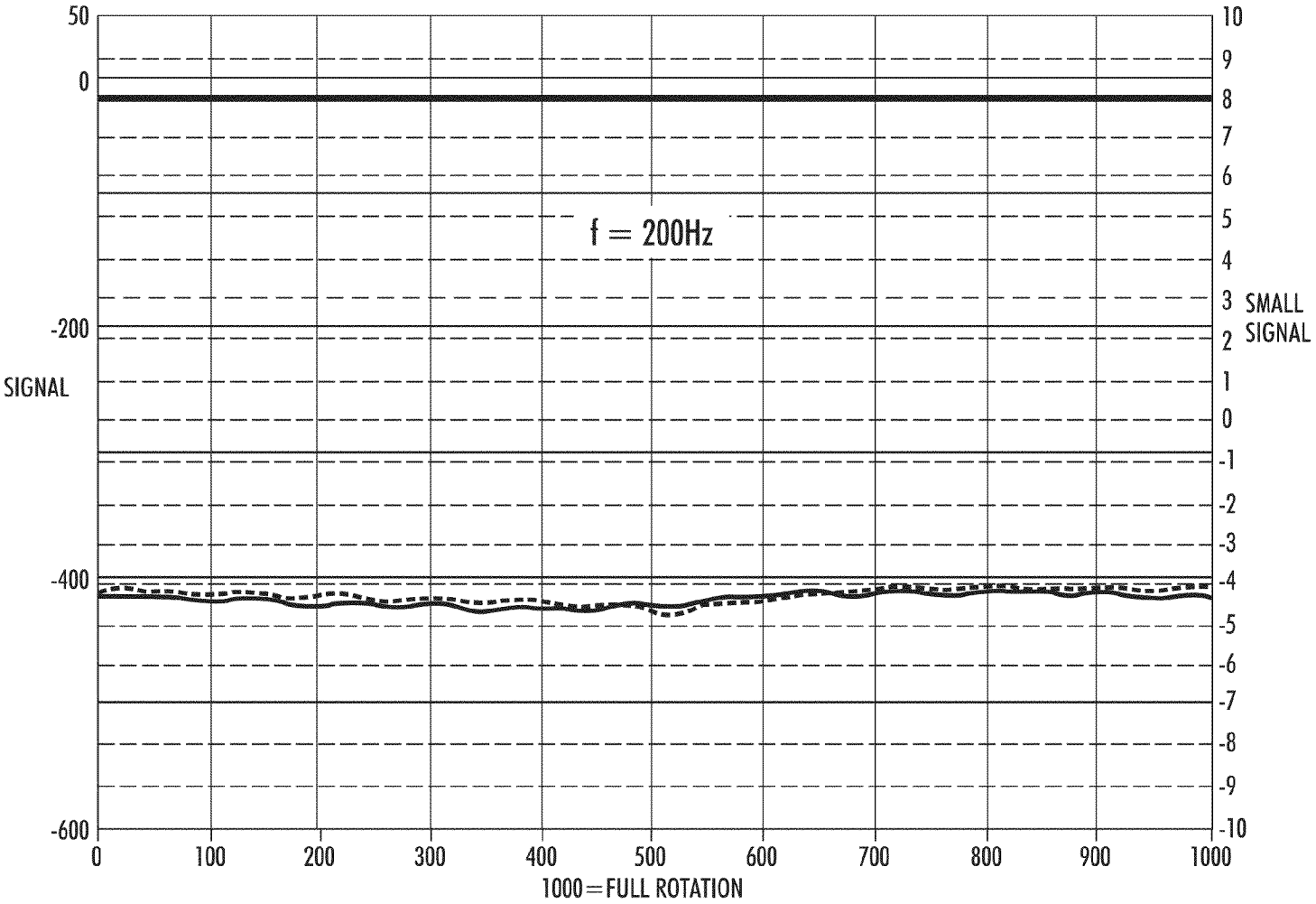
FIG. 3D is a chart showing results of a bias charging roll pulsed at a driving frequency of 200 Hz and an appearance of uniform charging.
Figure 3E:
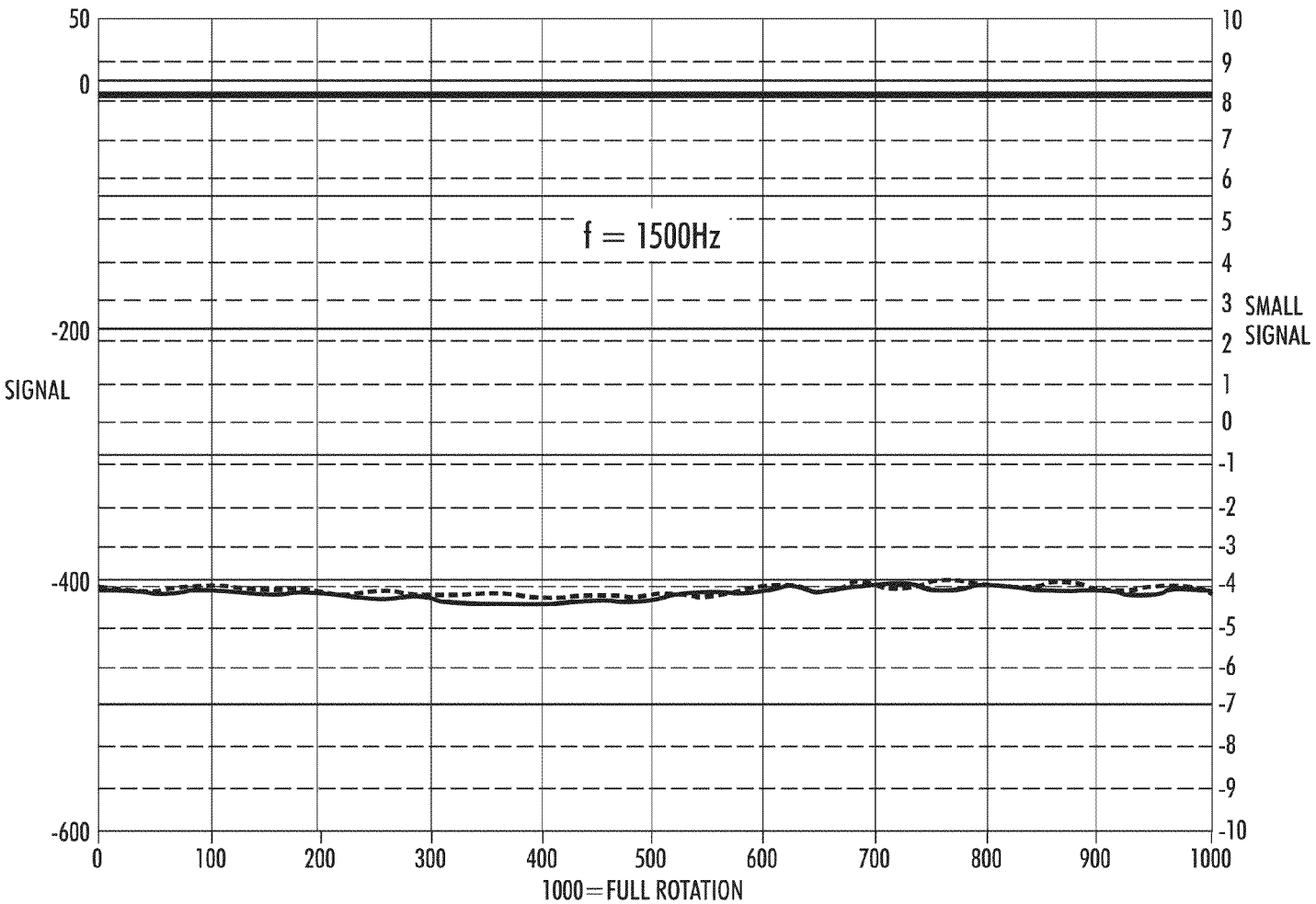
FIG. 3E is a chart showing a photoreceptor surface that is stably charged the same as the in-contact mode shown in FIG. 3A resulting from a bias charging roll pulsed at a driving frequency of 1500 Hz.
Figure 4:
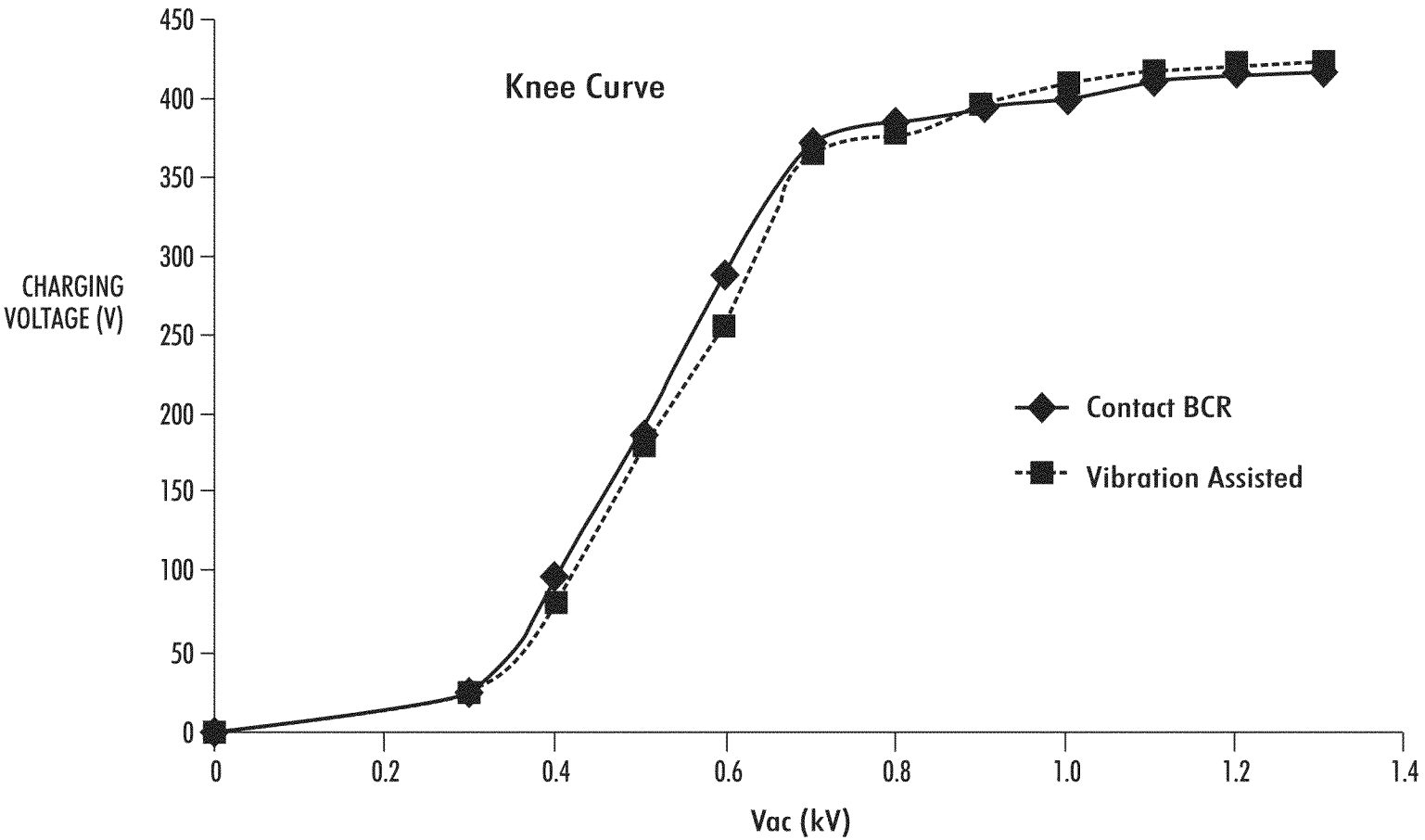
FIG. 4 is a chart showing knee curves of a contact bias charge roll in comparison with a vibration-assisted bias charge roll.

During testing, a driving amplitude ±400 μm was chosen. This amplitude has the potential to avoid trapping of charged toner/additives on the BCR surface. The HVPS on the BCR parameters were set as: Vdc=−500 V, amplitude of $V_{AC}$ from 0 to 1.3 kV, and a 1 kHz frequency. The frequency was tuned on the PZT to drive the BCR at different frequencies as shown in FIGS. 3A-E. As seen in FIG. 3A, in the contact mode, the BCR was statically in contact with a rotating photoreceptor and stably charged the photoreceptor. At frequencies of 0.5 Hz and 50 Hz in FIGS. 3B and 3C, there are visibly distorted charging curves as related with non-uniform charging. When the frequency was increased, such as 200 Hz in FIG. 3D, there is an appearance of charging uniformity. With frequencies above that, such as, at 1500 Hz shown in FIG. 3E, the photoreceptor surface was stably charged the same as the in-contact mode shown in FIG. 3A. Thus, it is seen that a BCR can be pulsed at high frequency into contact with a photoreceptor surface without affecting charging uniformity. Further, knee curves on a contact BCR and a vibration-assisted BCR are almost the same with similar knee $V_{AC}$, which is of importance because $V_{AC}$ has a significant impact on the wear rate of both bias charge members and photoreceptors. Pulsing of the bias charging roller can be at a frequency of from about 50 Hz to about 10 kHz and at an amplitude of from about 5 μm to about 1000 μm.

Is should now be apparent that an improved bias charging method has been disclosed that includes moving a vibrating bias charging member into and out of contact with a photoreceptor in order to achieve less wear on the photoreceptor. In addition, the bias charge member stays clean due to the vibration for a longer time thereby avoiding charging defects that lead to Image quality defects. Also, since the bias charge member surface is making contact with the photoreceptor only in short pulses, there is minimized friction force between the two solid bodies. Further, at idle times for the bias charge member, it could be lifted away from the photoreceptor to prevent long-term contact. With the bias charge member being pulsed into and out of contact with the photoreceptor the contact frequency could be modulated to relax both the bias charge member and the photoreceptor with minimized friction.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for reducing wear and contamination of a bias charging member and a surface portion of a photoreceptor, comprising:

providing a photoreceptor;

providing a bias charging member for charging said photoreceptor; and pulsing said bias charging member into and out of contact with a surface portion of said photoreceptor in order to reduce power consumption, toner contamination, and wear rate on both said surface portion of said photoreceptor and a surface portion of said bias charging member, and wherein said pulsing of said bias charging member into and out of contact with said surface portion of said photoreceptor is accomplished through vibration of said charging member against said surface portion of said photoreceptor.

2. The method of claim 1, wherein said pulsing of said bias charging member into and out of contact with said surface portion of said photoreceptor is accomplished with an actuator selected from a group consisting of a piezoelectric transducer, electrical motor, pneumatic actuator, hydraulic actuator, linear actuator, combo drive, thermal bimorphs and electroactive polymers.

3. The method of claim 1, wherein said pulsing of said bias charging member is at a frequency from about 100 Hz to about 10 kHz.

4. The method of claim 3, including modulating said frequency when said bias charging member is in the period of contact with said surface portion of said photoreceptor to reduce friction between said bias charging member and said surface portion of said photoreceptor.

5. The method of claim 1, wherein said pulsing of said bias charging roll with a duty cycle from about 5% to 95%.

6. The method of claim 1, wherein said pulsing of said bias charging member is at an amplitude from about 5 μm to about 1000 μm.

7. The method of claim 1, wherein said pulsing of said bias charging member has a waveform selected from a group consisting of square, sinusoid, and sawtooth.

8. The method of claim 1, wherein bias charging member is selected from a group consisting of a roller, a brush, a pad and a blade.

9. The method of claim 1, including lifting said bias charging member away from said photoreceptor during idle time to prevent long-term contact between said bias charging member and said photoreceptor.

10. The method of claim 1, wherein the surface resistivity of said bias charging member is from about 103 ohm/m to about 1013 ohm/m.

11. The method of claim 1, wherein said method for reducing wear and contamination of a bias charging member is used in a xerographic apparatus.

12. A bias charging unit comprising:

a bias charging member with an electrically conductive core;

an outer layer axially supported on the core; and an actuator that pulses said bias charging member into and out of contact with a surface portion of a photoreceptor in order to reduce power consumption, toner contamination, and wear rate on both said surface portion of said photoreceptor and a surface portion of said bias charging member, and wherein a pulsing frequency of said actuator is from about 100 Hz to about 10 kHz.

13. The bias charging unit of claim 12, wherein the actuator is selected from a group consisting of a piezoelectric transducer, electrical motor, pneumatic actuator, hydraulic actuator, linear actuator, combo drive, thermal bimorphs and electroactive polymers.

14. The bias charging unit of claim 12, wherein a pulsing duty cycle of said actuator is from about 5% to about 95%.

15. The bias charging unit of claim 12, wherein a surface resistivity of said bias charging member is from about 103 ohm/m to about 1013 ohm/m.

16. The bias charging unit of claim 12, wherein said bias charging member is selected from a group consisting of a roller, a brush, a pad, and a blade.

17. An image forming apparatus comprising:

an electrophotographic imaging member having a charge retentive surface configured to receive an electrostatic latent image;

a development component to apply a developer materials to the charge retentive surface to form a developed image on the charge retentive surface;

a transfer component for transferring the developed image from the charge retentive surface to a substrate; and a bias charging member, said bias charging member comprising:

an electrically conductive core;

an outer layer axially supported on the core; and an actuator adapted to pulse the bias charging member into and out of contact with said charge retentive surface of said electrophotographic imaging member in order to reduce power consumption, toner contamination, and wear rate on both said surface portion of said electrophotographic imaging member and a surface portion of said bias charging member, and wherein the bias charging member is vibrated from about 100 Hz to about 10 kHz.

* * * * *